US008113293B2

(12) United States Patent
Corre

(10) Patent No.: US 8,113,293 B2
(45) Date of Patent: Feb. 14, 2012

(54) SINGLE PACKER STRUCTURE FOR USE IN A WELLBORE

(75) Inventor: Pierre-Yves Corre, Eu (FR)

(73) Assignee: Schlumberger Technology Corporation, Sugar Land, TX (US)

( * ) Notice: Subject to any disclaimer, the term of this patent is extended or adjusted under 35 U.S.C. 154(b) by 384 days.

(21) Appl. No.: 12/350,296

(22) Filed: Jan. 8, 2009

(65) Prior Publication Data

US 2010/0122822 A1 May 20, 2010

Related U.S. Application Data

(60) Provisional application No. 61/116,494, filed on Nov. 20, 2008.

(51) Int. Cl.
*E21B 33/127* (2006.01)

(52) U.S. Cl. ..... 166/387; 166/187; 166/264; 166/145; 166/186; 175/59

(58) Field of Classification Search ..... 166/387, 166/187, 264, 145, 186, 188; 175/59
See application file for complete search history.

(56) References Cited

U.S. PATENT DOCUMENTS

| | | | | |
|---|---|---|---|---|
| 2,441,894 | A | 5/1948 | Mennecier | |
| 2,511,759 | A | 6/1950 | Williams | |
| 2,516,580 | A * | 7/1950 | Lynes | 166/141 |
| 2,581,070 | A | 1/1952 | Blood | |
| 2,600,173 | A | 6/1952 | Sewell et al. | |
| 2,623,594 | A | 12/1952 | Sewell | |
| 2,675,080 | A | 4/1954 | Williams | |
| 2,742,968 | A | 4/1956 | Hildebrandt | |
| 2,842,210 | A | 7/1958 | Ramsey | |
| 3,181,608 | A * | 5/1965 | Palmer | 166/250.02 |
| 3,915,229 | A | 10/1975 | Nicolas | |
| 3,926,254 | A | 12/1975 | Evans et al. | |
| 4,236,113 | A | 11/1980 | Wiley | |
| 4,500,095 | A | 2/1985 | Schisler et al. | |
| 2,843,208 | A | 7/1985 | Blood | |
| 4,635,717 | A | 1/1987 | Jageler | |
| 4,830,105 | A | 5/1989 | Petermann | |
| 4,886,117 | A | 12/1989 | Patel | |
| 4,923,007 | A | 5/1990 | Sanford et al. | |
| 5,358,039 | A | 10/1994 | Fordham | |
| 5,361,836 | A | 11/1994 | Sorem et al. | |
| 5,404,947 | A | 4/1995 | Sorem et al. | |
| 5,439,053 | A | 8/1995 | Eslinger et al. | |
| 5,549,159 | A * | 8/1996 | Shwe et al. | 166/250.02 |
| 5,605,195 | A | 2/1997 | Eslinger et al. | |
| 5,613,555 | A | 3/1997 | Sorem et al. | |
| 5,687,795 | A | 11/1997 | Patel et al. | |
| 6,315,050 | B2 | 11/2001 | Vaynshteyn et al. | |

(Continued)

FOREIGN PATENT DOCUMENTS

| | | |
|---|---|---|
| EP | 0528327 | 2/1993 |

(Continued)

*Primary Examiner* — Nicole Coy
(74) *Attorney, Agent, or Firm* — David J. Smith

(57) ABSTRACT

A technique involves collecting formation fluids through a single packer having at least one drain located within the single packer. The single packer is designed with an outer flexible skin and one or more drains coupled to the outer flexible skin. A mandrel is positioned within the outer flexible skin, and an expansion mechanism is provided to control expansion of the outer flexible skin to selectively create sealing engagement with a surrounding wall.

23 Claims, 6 Drawing Sheets

U.S. PATENT DOCUMENTS

| | | | | |
|---|---|---|---|---|
| 6,513,600 | B2 | 2/2003 | Ross | |
| 6,564,876 | B2 | 5/2003 | Vaynshteyn et al. | |
| 6,729,399 | B2 | 5/2004 | Follini et al. | |
| 6,854,522 | B2 * | 2/2005 | Brezinski et al. | 166/387 |
| 6,865,933 | B1 | 3/2005 | Einarson et al. | |
| 6,938,698 | B2 | 9/2005 | Coronado | |
| 7,874,356 | B2 * | 1/2011 | Corre et al. | 166/187 |
| 2002/0014339 | A1 | 2/2002 | Ross | |
| 2002/0017386 | A1 | 2/2002 | Ringgenberg et al. | |
| 2004/0099443 | A1 | 5/2004 | Meister et al. | |
| 2007/0151724 | A1 * | 7/2007 | Ohmer et al. | 166/187 |

FOREIGN PATENT DOCUMENTS

| | | |
|---|---|---|
| EP | 0528328 | 2/1993 |
| EP | 0702747 | 3/1996 |
| WO | 03/018956 | 3/2003 |

* cited by examiner

SINGLE PACKER STRUCTURE FOR USE IN A WELLBORE

CROSS-REFERENCE TO RELATED APPLICATION

This application claims priority under 35 U.S.C. §119(e) to U.S. Provisional Application Ser. No. 61/116,494, filed on Nov. 20, 2008, which is incorporated herein by reference.

BACKGROUND

Packers are used in wellbores to isolate specific wellbore regions. A packer is delivered downhole on a conveyance and expanded against the surrounding wellbore wall to isolate a region of the wellbore. Two or more packers can be used to isolate one or more regions in a variety of well related applications, including production applications, service applications and testing applications.

In some applications, straddle packers are used to isolate specific regions of the wellbore to allow collection of fluid samples. However, straddle packers employ a dual packer configuration in which fluids are collected between two separate packers. The straddle packer configuration is susceptible to mechanical stresses which limit the expansion ratio and the drawdown pressure differential that can be employed. Other multiple packer techniques can be expensive and present additional difficulties in collecting samples and managing fluid flow in the wellbore environment.

SUMMARY

In general, the present invention provides a system and method for collecting formation fluids through a single packer having at least one drain located within the single packer. The single packer is designed with an outer flexible skin and one or more drains coupled to the outer flexible skin. A mandrel is positioned within the outer flexible skin, and an expansion mechanism is provided to control expansion of the outer flexible skin. For example, portions of the outer flexible skin can be expanded into sealing engagement with a surrounding wall.

BRIEF DESCRIPTION OF THE DRAWINGS

Certain embodiments of the invention will hereafter be described with reference to the accompanying drawings, wherein like reference numerals denote like elements, and.

DETAILED DESCRIPTION

In the following description, numerous details are set forth to provide an understanding of the present invention. However, it will be understood by those of ordinary skill in the art that the present invention may be practiced without these details and that numerous variations or modifications from the described embodiments may be possible.

The present invention generally relates to a system and method for collecting formation fluids through one or more drains located in a single packer. Use of the single packer enables larger expansion ratios and higher drawdown pressure differentials. Additionally, the single packer configuration reduces the stresses otherwise incurred by the packer tool mandrel due to the differential pressures. In at least some embodiments, the single packer also is better able to support the formation in a produced zone at which formation fluids are collected. This quality facilitates relatively large amplitude draw-downs even in weak, unconsolidated formations.

The single packer expands across an expansion zone, and formation fluids can be collected from the middle of the expansion zone, i.e. between axial ends of the single packer. The formation fluid is collected and directed along flow lines, e.g. along flow tubes, from the one or more drains. For example, separate drains can be disposed along the length of the packer to establish collection intervals or zones that enable focused sampling at a plurality of collecting intervals, e.g. two or three collecting intervals. Separate flowlines can be connected to different drains, e.g. sampling drains and guard drains, to enable the collection of unique formation fluid samples.

The single packer provides a simplified packer structure that facilitates, for example, focused sampling. In one embodiment, an outer flexible layer, e.g. an outer rubber layer, contains three groups of drains in which a middle group comprises sampling drains and two axially outer groups comprise guard drains. The drains may be coupled to the flowlines through extensible members, or extensible members can be used in other configurations to facilitate expansion and contraction of the single packer without causing damage.

Figure 1:
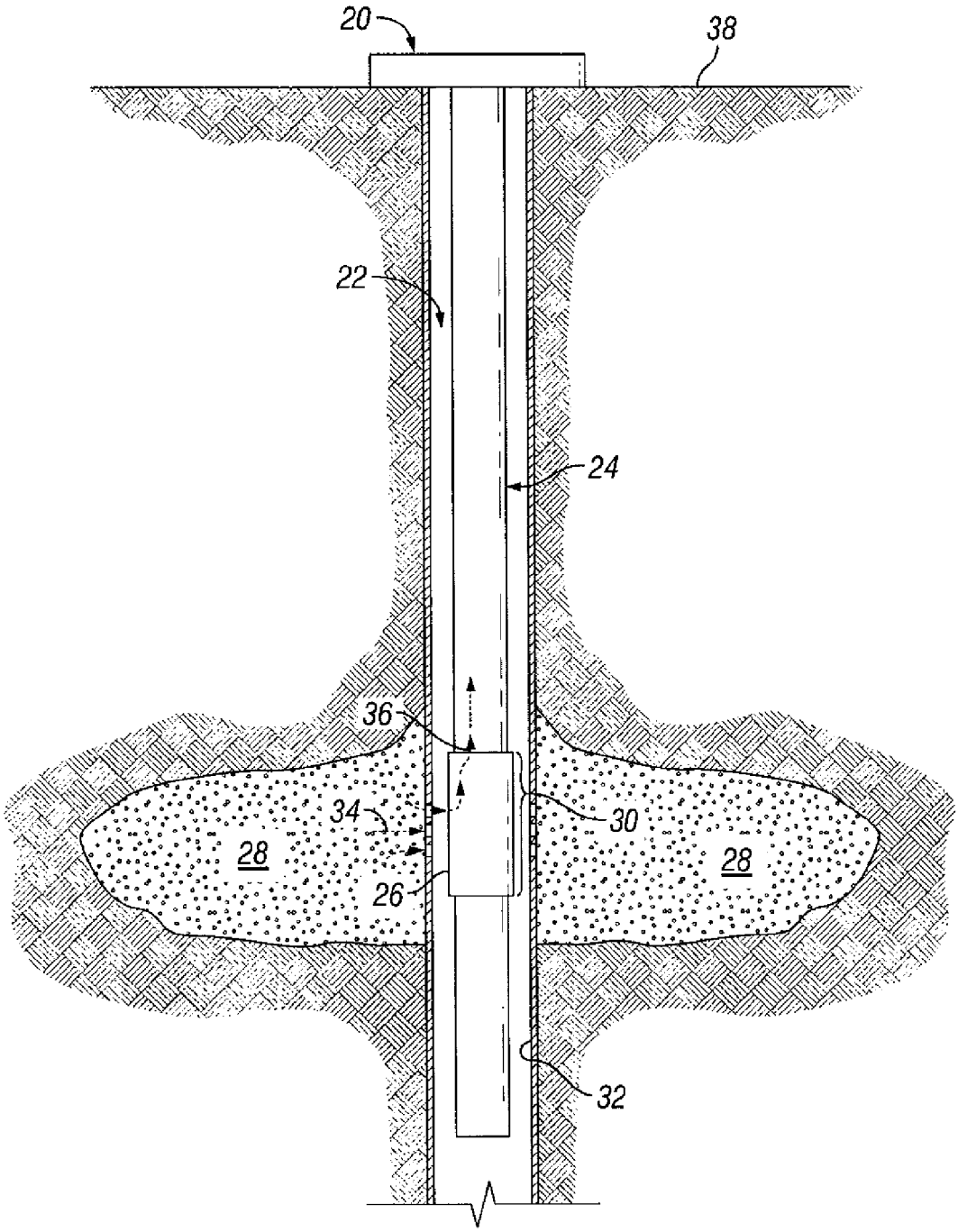
FIG. 1 is a schematic front elevation view of a well system having a single packer through which formation fluids can be collected, according to an embodiment of the present invention.

Referring generally to FIG. 1, one embodiment of a well system 20 is illustrated as deployed in a wellbore 22. The well system 20 comprises a conveyance 24 employed to deliver at least one single packer 26 downhole. In many applications, packer 26 is deployed by conveyance 24 in the form of a wireline or other cable type conveyance. However, conveyance 24 may have other forms, including coiled tubing or other tubing, for use in other applications. In the embodiment illustrated, packer 26 is a single packer configuration used to collect formation fluids from a surrounding formation 28. The packer 26 is selectively expanded in a radially outward direction to seal across an expansion zone 30 with a surrounding wall 32, such as a surrounding wellbore wall in the form of a casing or open wellbore wall. When packer 26 is expanded to seal against wall 32, formation fluids can be flowed into packer 26, as indicated by arrows 34. The formation fluids are then directed to one or more flow lines, as represented by arrows 36, and produced to a collection location, such as a location at a well site surface 38.

Figure 2:
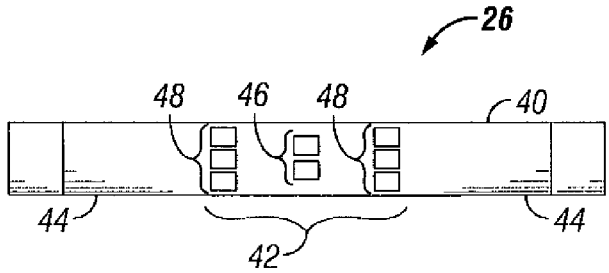
FIG. 2 is a front view of one example of the single packer illustrated in FIG. 1, according to an embodiment of the present invention.

Referring generally to FIG. 2, one embodiment of single packer 26 is illustrated. In this embodiment, packer 26 comprises an outer flexible skin 40 in which a plurality of drains 42 is mounted. The outer flexible skin 40 comprises axially outer regions 44 that may be used to form seals with the surrounding wall 32 when single packer 26 is expanded. The drains 42 are disposed between axially outer regions 44 and may comprise one or more sample drains 46 and one or more guard drains 48. In the example illustrated, a plurality of sample drains 46 is surrounded by a plurality of guard drains 48 that are disposed on both axial sides of the sample drains 46. For example, the drains may be organized in three groups in which the two outer groups comprise guard drains 48 that are connected to a flow line, as described in greater detail below, to clean formation fluid during sampling. The inner group comprises sampling drains 46 that are connected to another flow line to collect formation fluid for sampling.

Figure 3:
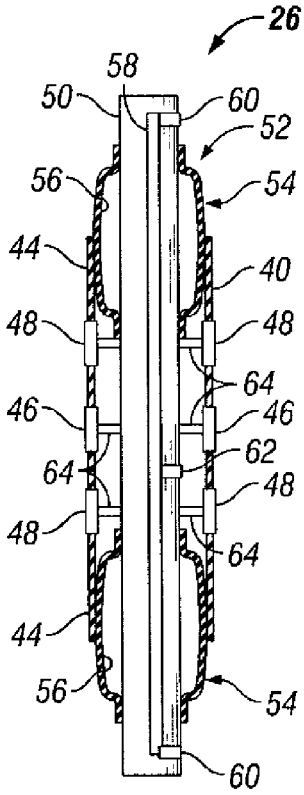
FIG. 3 is a view similar to that of FIG. 2 but showing internal components of the single packer, according to an embodiment of the present invention.

Referring generally to FIG. 3, a more detailed example of single packer 26 is illustrated. As illustrated, a mandrel 50 is located within outer flexible skin 40, and an expansion mechanism 52 is positioned between mandrel 50 and outer flexible skin 40 to control radial expansion and contraction of the outer flexible skin. In this embodiment, expansion mechanism 52 comprises a pair of expansion members 54 with an individual expansion member 54 positioned at each axial end of the outer flexible skin 40. The expansion members 54 may be expanded and contracted to control the radial movement of, for example, axially outer regions 44 out of outer flexible skin 40. Expansion members 54 may comprise a variety of structures, and one suitable structure is an inflatable bladder 56. The inflatable bladders 56 are positioned generally between the outer flexible skin 40 and mandrel 50 at each axial end of the outer flexible skin.

The outer flexible skin 40 may be formed of a polymeric material, e.g. rubber material, that has sufficient thickness to withstand the forces and environmental effects of the downhole environment. The outer flexible skin 40 also may be reinforced with fibers, metallic cables, or other structures designed to provide strength and/or support. Openings are formed through the outer flexible skin 40 for receipt of the drains 46, 48. By way of example, the drains may be formed from a metallic material and bonded to outer flexible skin 40 within the openings formed to receive the drains. Inflatable bladders 56 also can be formed from such materials that include, for example, a rubber component.

Mandrel 50 also may comprise a bypass passage 58 to enable pressure equalization between the wellbore and the interior region within outer flexible skin 40. The bypass 58 may comprise a passage having external ports 60 exposed to an annulus surrounding the mandrel 50 outside of outer flexible skin 40 and expansion members 54. Bypass 58 also may comprise an internal port 62 exposed within outer flexible skin 40 between expansion members 54. The external ports 60 and internal port 62 enable fluid flow and thus pressure equalization through the bypass 58.

Figure 4:
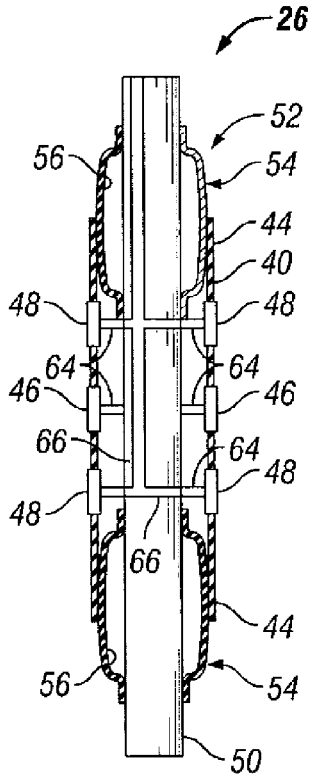
FIG. 4 is a view similar to that of FIG. 3 showing a flow line coupled to guard drains, according to an embodiment of the present invention.
Figure 5:
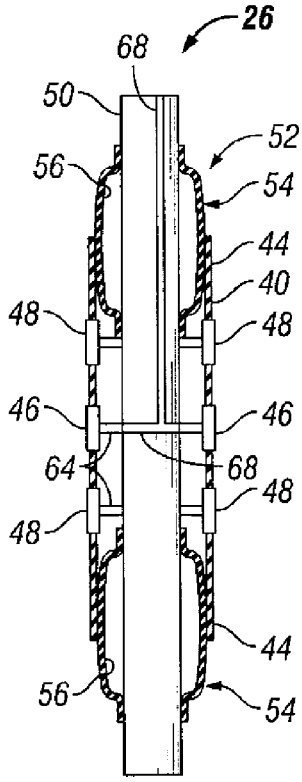
FIG. 5 is a view similar to that of FIG. 3 showing a flow line coupled to sample drains, according to an embodiment of the present invention.

As further illustrated in FIGS. 4 and 5, extensible members 64 can be used to couple drains 46, 48 with flow lines. The extensible members 64 enable radial movement of outer flexible skin 40 and drains 46, 48 during, for example, expansion of expansion members 54 and/or outer flexible skin 40. In the embodiment illustrated in FIG. 4, extensible members 64 are used to couple guard drains 48 with one or more guard drain flow lines 66. Similarly, extensible members 64 also can be used to couple sample drains 46 with one or more sample drain flow lines 68, as illustrated in FIG. 5. In this example, the flow lines 66, 68 are routed along mandrel 50, e.g. inside, within, or along the mandrel exterior.

Figure 6:
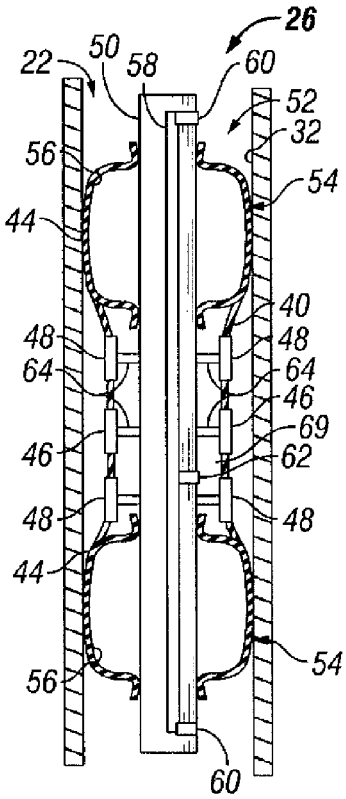
FIG. 6 is a view of one example of the single packer in an expanded configuration, according to an embodiment of the present invention.
Figure 7:
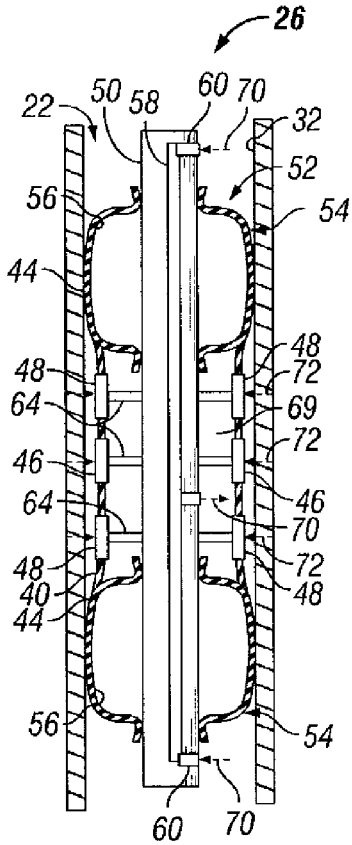
FIG. 7 is another view of one example of the single packer in an expanded configuration, according to an embodiment of the present invention.
Figure 8:
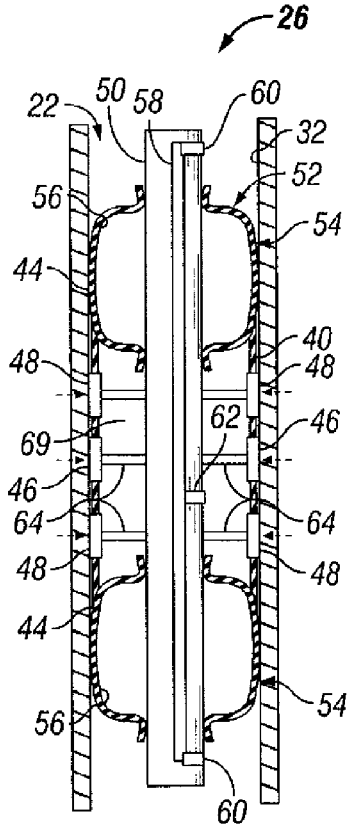
FIG. 8 is another view of one example of the single packer in an expanded configuration, according to an embodiment of the present invention.

The inflatable bladders 56 may be selectively inflated and deflated. In the example provided in FIG. 6, the inflatable bladders 56 have been inflated to expand the axially outer regions 44 of outer flexible skin 40 and/or portions of the inflatable bladders 56 against the surrounding wellbore wall 32. The outer flexible skin 40 is free and can be independently expanded or contracted, e.g. inflated or deflated, depending on the natural pressure balance between an interior 69 of the outer flexible skin 40 and the well pressure. Expansion of the flexible outer skin 40 can be independently achieved via application of pressure through bypass 58, as further illustrated by arrows 70 in FIG. 7. Furthermore, the outer flexible skin 40 may naturally expand when draw down is applied through drains 46, 48 to intake fluid, as represented by arrows 72. Again, expansion of the flexible outer skin 40 is accommodated by the ability to transfer fluid/pressure via bypass 58. As illustrated in FIG. 8, application of sufficient draw down can expand drains and 46, 48 and outer flexible skin 40 against the surrounding wellbore wall 32. If the outer expansion members 54 are pressure resistant, the single packer 26 can be used to perform minifrac operations.

Figure 9:
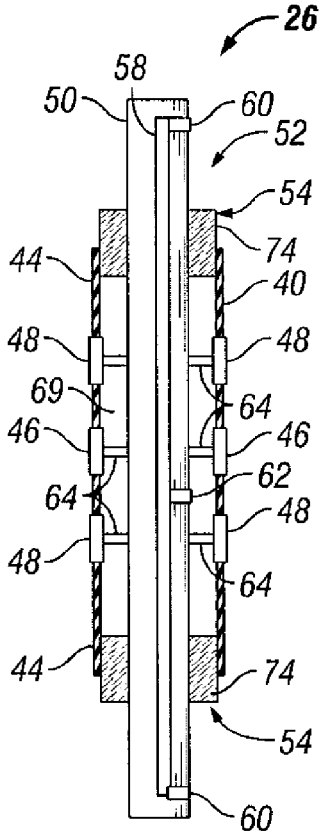
FIG. 9 is a view of an alternate single packer having a mechanical expansion system, according to an alternate embodiment of the present invention.

An alternate embodiment of single packer 26 is illustrated in FIG. 9. In this embodiment, expansion mechanism 52 is constructed with expansion members 54 comprising mechanical expansion members 74. One or both of the mechanical expansion members 74 is designed to selectively move outer flexible skin 40 in a radial direction toward and/or away from surrounding wall 32. By way of example, one or both mechanical expansion members 74 can be actuated to expand radially or to move axially so as to force the outer flexible skin 40 to bulge in a radially outward direction during expansion. The mechanical expansion members are designed to ensure that at least a portion of the outer flexible skin 40 conforms to the wall 32 under sufficient pressure/force to provide sealing efficiency.

Figure 10:
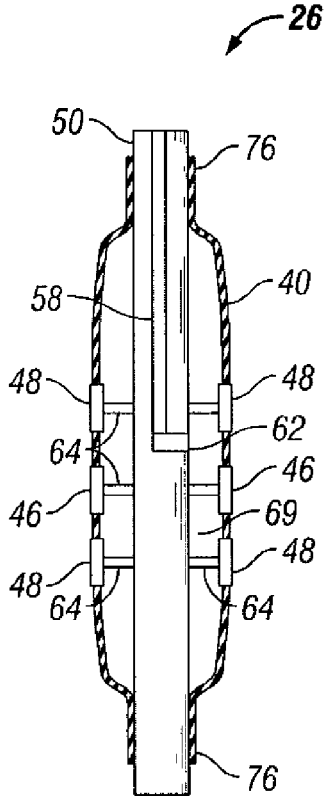
FIG. 10 is a view of another single packer example, according to an alternate embodiment of the present invention.

In another embodiment, the drains 46, 48 are similarly mounted, e.g. bonded, within outer flexible skin 40. However, axial ends 76 of outer flexible skin 40 are secured to mandrel 50, as illustrated in FIG. 10. For example, the axial ends 76 can be bonded to mandrel 50 to form the sealed interior region 69 around drains 46, 48 between mandrel 50 and outer flexible skin 40. Expansion and contraction of outer flexible skin 40 is controlled by inflating and deflating the sealed interior region within the outer flexible skin 40. For example, pressurized fluid can be moved into or out of the sealed interior region 69 via flow paths along mandrel 50, such as bypass passage 58.

Figure 11:
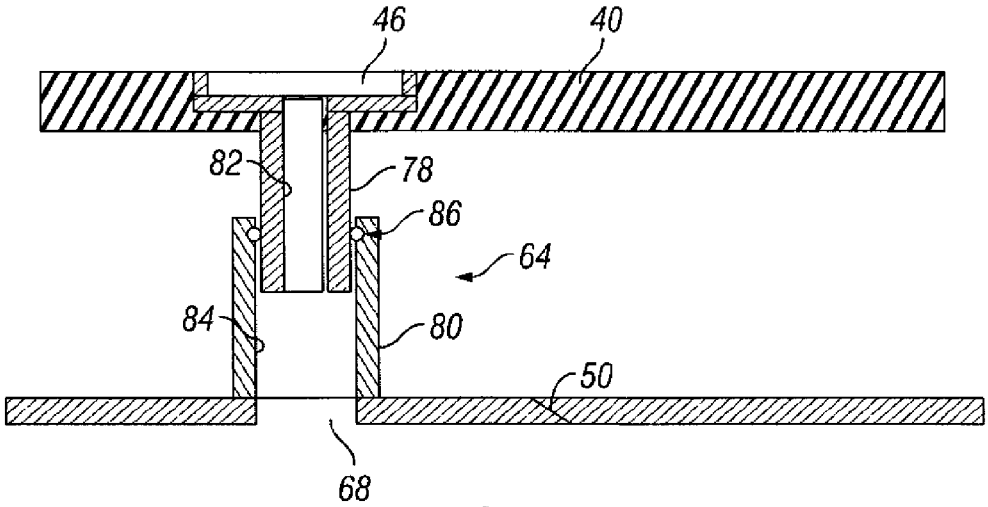
FIG. 11 is a schematic illustration of an extensible member used to couple a drain with a flow line, according to an embodiment of the present invention.

Referring generally to FIG. 11, one embodiment of an extensible member 64 for coupling a drain with a flow line is illustrated. In this example, extensible member 64 comprises telescopic tubes 78, 80. The telescopic tubes 78, 80 can be used with both guard drains 48 and sample drains 46 but a sample drain is illustrated simply for purposes of explanation. In this example, telescopic tube 78 is connected to one of the sample drains 46 and comprises an inner passage 82 that allows fluid flow from drain 46. Tube 78 is sized for sliding, telescopic movement within an interior passage 84 of telescopic tube 80 that enables tube 78 to move radially outward and inward with respect to tube 80. In the embodiment illustrated, telescopic tube 80 is coupled with mandrel 50 to allow flow into the corresponding flow line, e.g. flow line 68. Additionally, a seal 86, such as an O-ring seal may be disposed between telescopic tubes 78 and 80 to ensure maintenance of a pressure seal throughout the telescopic movement of tubes 78, 80 during expansion and contraction of outer flexible skin 40.

Figure 12:
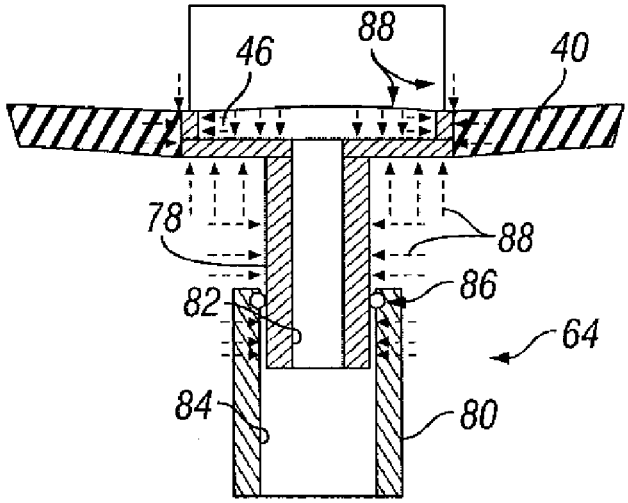
FIG. 12 is a schematic illustration of pressure acting on the extensible member, according to an embodiment of the present invention.

In some applications, the surface of the drain 46 or 48 is specifically sized relative to the surface area of the moving telescopic tube 78. By optimizing the relative exposed surface areas, system stability can be enhanced. In one example illustrated in FIG. 12, the surface areas are selected so that stability is obtained when the drain 46/48 seals against the wellbore wall 32. The pressure differential, as represented by arrows 88, across the drain surface helps hold the movable telescopic tube 78 in the deployed configuration.

Figure 13:
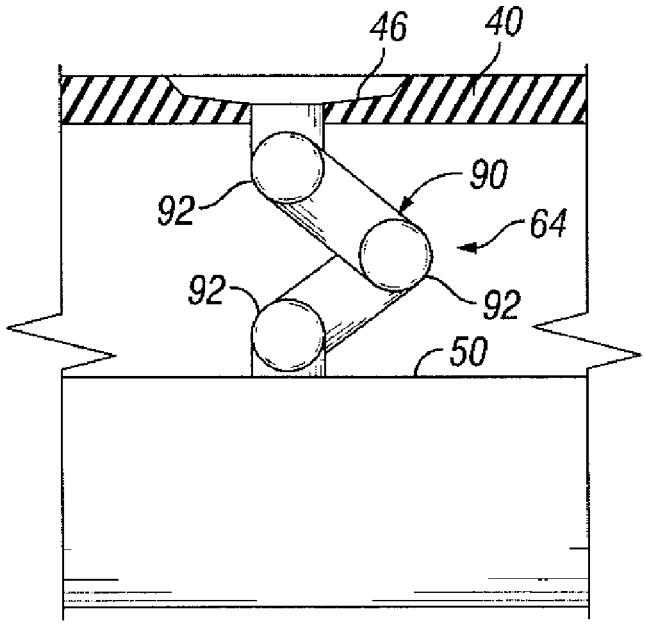
FIG. 13 is a schematic illustration of an alternate extensible member used to couple a drain with a flow line, according to an alternate embodiment of the present invention.

Referring generally to FIG. 13, another embodiment of extensible member 64 is illustrated. In this embodiment, the drain 46 or 48 is connected to its corresponding flow line 66 or 68 in mandrel 50 via an articulated tube 90. Articulated tube 90 comprises a plurality of pivot joints 92 that allow the tube to extend or retract during corresponding radial expansion or contraction of flexible outer skin 40. The articulated member enables deployment at a constant volume, and the system remains stables provided the drain is wider than the articulated tube 90.

Figure 14:
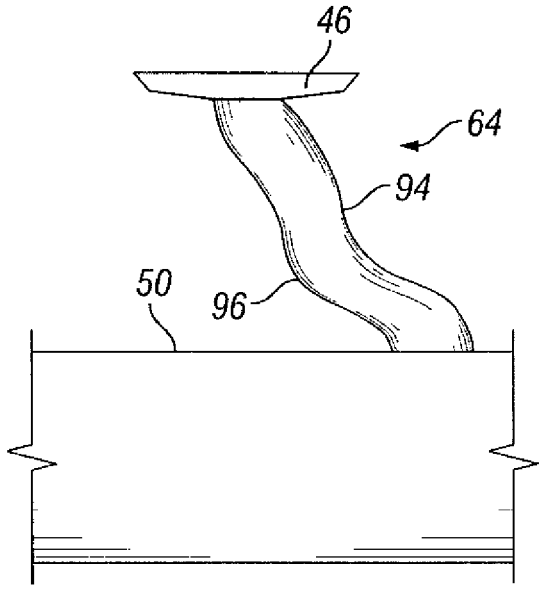
FIG. 14 is a schematic illustration of an alternate extensible member used to couple a drain with a flow line, according to an alternate embodiment of the present invention.

Another embodiment of extensible member 64 is illustrated in FIG. 14. In this embodiment, the drain 46 or 48 is connected to its corresponding flow line 66 or 68 in mandrel 50 via a flexible tube 94. Flexible tube 94 comprises a material 96 that allows the tube to fold, bend or otherwise flex to accommodate radial contraction and to similarly unfold, unbend or otherwise flex to accommodate radial expansion of flexible outer skin 40. By way of example, material 96 may comprise a polymer material or a composite material with sufficient flexibility. The length of flexible tube 94 may vary according to its flexibility.

Figure 15:
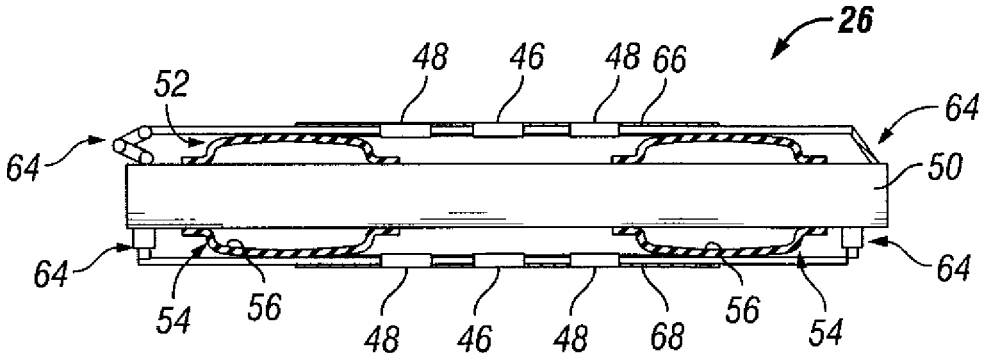
FIG. 15 is a view of another example of the single packer, according to an alternate embodiment of the present invention.

Another alternate embodiment of the single packer 26 is illustrated in FIG. 15. In this embodiment, flow lines 66, 68 are embedded in at least a portion of the outer flexible skin 40. The expansion members 54, e.g. inflatable bladders 56, may be located within the flow lines. However, the flow lines 66, 68 can be redirected back to mandrel 50 at an axially outlying location with respect to expansion members 54, as illustrated in FIG. 15. In this latter example, extensible members 64, e.g. telescopic members, articulated members, flexible members, or other suitable members, can be positioned at the axially outlying locations as illustrated to accommodate radial expansion and contraction of the outer flexible skin 40.

Also, in any of the embodiments described above where a component is described as being formed of rubber or comprising rubber, the rubber may include an oil resistant rubber, such as NBR (Nitrile Butadiene Rubber), HNBR (Hydrogenated Nitrile Butadiene Rubber) and/or FKM (Fluoroelastomers). In a specific example, the rubber may be a high percentage acrylonytrile HNBR rubber, such as an HNBR rubber having a percentage of acrylonytrile in the range of approximately 21 to approximately 49%. Components suitable for the rubbers described in this paragraph include, but are not limited to, outer flexible skin 40 and inflatable bladders 56.

As described above, well system 20 may be constructed in a variety of configurations for use in many environments and applications. The single packer 26 may be constructed from different types of materials and components for collection of formation fluids from single or multiple intervals within a single expansion zone. The ability to expand the outer flexible skin across the entire expansion zone enables use of packer 26 in many well environments. The various drain features and flow system arrangements also can be constructed in several configurations to provide a more reliable and efficient single packer design. Furthermore, the outer flexible skin can be formed from a variety of materials, including composite materials, for cooperation with various expansion members. Additionally, the mandrel configuration and flow line arrangements can vary between different applications and different environments.

Accordingly, although only a few embodiments of the present invention have been described in detail above, those of ordinary skill in the art will readily appreciate that many modifications are possible without materially departing from the teachings of this invention. Such modifications are intended to be included within the scope of this invention as defined in the claims.

What is claimed is:

1. A system for collecting fluid in a wellbore, comprising:
a single packer having: an outer flexible skin;
a plurality of drains coupled to the outer flexible skin and connected with corresponding flow lines;
a mandrel positioned within the outer flexible skin; and
an expansion mechanism having an expansion member positioned at each axial end of the outer flexible skin, the expansion mechanism being actuatable to control radial expansion of the outer flexible skin wherein the mandrel is configured with a bypass passage with at least two external ports exposed to an annulus and the external ports at opposite ends of the packer and an internal port exposed within the outer flexible skin.

2. The system as recited in claim 1, wherein the expansion mechanism comprises an inflatable bladder positioned at each axial end of the outer flexible skin.

3. The system as recited in claim 1, wherein the expansion mechanism comprises a mechanical expansion member positioned at each axial end of the outer flexible skin.

4. The system as recited in claim 1, wherein the plurality of drains comprises at least one sampling drain positioned between guard drains.

5. The system as recited in claim 1, wherein the plurality of drains is coupled to the corresponding flow lines via telescopic tubes.

6. The system as recited in claim 1, wherein the plurality of drains is coupled to the corresponding flow lines via articulated tubes.

7. The system as recited in claim 1, wherein the plurality of drains is coupled to the corresponding flow lines via flexible tubes.

8. The system as recited in claim 1, wherein the corresponding flow lines are embedded at least in part in the outer flexible skin.

9. A method, comprising:
forming a single packer with an outer flexible skin surrounding an inner mandrel;

locating a drain in the outer flexible skin between axial ends of the outer flexible skin;

coupling a fluid flow line with the drain to conduct fluid intaken through the drain; and positioning an expansion mechanism about the mandrel to enable selective radial expansion and contraction of the outer flexible skin wherein the mandrel is configured with a bypass passage with at least two external ports exposed to an annulus and the external ports at opposite ends of the packer and an internal port exposed within the outer flexible skin.

10. The method as recited in claim 9, wherein positioning comprises positioning a pair of inflatable bladders in cooperation with the outer flexible skin such that an inflatable bladder is located between the mandrel and the outer flexible skin at each axial end of the outer flexible skin.

11. The method as recited in claim 9, wherein positioning comprises positioning a mechanical expansion member at each axial end.

12. The method as recited in claim 9, wherein coupling comprises coupling the fluid flow line with the drain via telescopic tub.

13. The method as recited in claim 9, wherein coupling comprises coupling the fluid flow line with the drain via articulated tube.

14. The method as recited in claim 9, wherein coupling comprises coupling the fluid flow line with the drain via flexible tube.

15. The method as recited in claim 9, wherein forming comprises forming the outer flexible skin from an oil resistant rubber material.

16. A device, comprising:

a single packer having an outer flexible skin with axially outer regions designed to form a seal with a surrounding wellbore wall, the single packer further comprising:

a pair of expansion members with an expansion member positioned at each axially outer region to selectively move the axial outer regions into sealing engagement with the surrounding wellbore wall;

a plurality of sample drains guarded by a plurality of guard drains positioned in the outer flexible skin; and a mandrel disposed within the outer flexible skin and having a bypass passage extending to a region within the outer flexible skin between the pair of expansion members wherein the mandrel is configured with a bypass passage with at least two external ports exposed to an annulus and the external ports at opposite ends of the packer and an internal port exposed within the outer flexible skin.

17. The device as recited in claim 16, wherein the plurality of sample drains is coupled to a sample drain flow line; and the plurality of guard drains is coupled to a separate guard drain flow line.

18. The device as recited in claim 16, wherein the pair of expansion members comprises a pair of inflatable bladders formed from an oil resistant rubber material.

19. The device as recited in claim 16, wherein the plurality of sample drains is coupled to a sample drain flow line via a telescopic tube.

20. The device as recited in claim 16, wherein the plurality of sample drains is coupled to a sample drain flow line via an articulated tube.

21. The device as recited in claim 16, wherein the plurality of sample drains is coupled to a sample drain flow line via a flexible tube.

22. A system, comprising:

a single packer, having:

a mandrel having a guard flow line separated from a sample flow line;

a flexible skin surrounding the mandrel and having axial ends secured in sealing engagement with the mandrel;

a plurality of drains mounted in the flexible skin; and a plurality of extensible members coupling the plurality of drains with the guard flow line and the sample flow line to accommodate expansion and contraction of the flexible skin between its axial ends wherein the mandrel is configured with a bypass passage with at least two external ports exposed to an annulus and the external ports at opposite ends of the packer and an internal port exposed within the flexible skin.

23. The system as recited in claim 22, wherein the plurality of drains comprises a plurality of sample drains between a plurality of guard drains.

* * * * *